US008387397B2

(12) United States Patent
Chen et al.

(10) Patent No.: US 8,387,397 B2
(45) Date of Patent: Mar. 5, 2013

(54) FLOW CONDITIONER FOR USE IN GAS TURBINE COMPONENT IN WHICH COMBUSTION OCCURS

(75) Inventors: Wei Chen, Greer, SC (US); Ronald James Chila, Greer, SC (US); Eric William King, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 746 days.

(21) Appl. No.: 12/360,490

(22) Filed: Jan. 27, 2009

(65) Prior Publication Data

US 2010/0186416 A1 Jul. 29, 2010

(51) Int. Cl.
*F02C 1/00* (2006.01)
*F02G 3/00* (2006.01)

(52) U.S. Cl. ..... 60/759; 60/752

(58) Field of Classification Search ..... 60/752–760
See application file for complete search history.

(56) References Cited

U.S. PATENT DOCUMENTS

| | | | | |
|---|---|---|---|---|
| 2,601,000 | A * | 6/1952 | Nerad | 60/758 |
| 3,545,202 | A * | 12/1970 | Batt et al. | 60/757 |
| 3,981,142 | A * | 9/1976 | Irwin | 60/753 |
| 5,187,937 | A * | 2/1993 | Stevens et al. | 60/752 |
| 2005/0047932 | A1 * | 3/2005 | Nakae et al. | 417/313 |
| 2008/0115498 | A1 * | 5/2008 | Patel et al. | 60/752 |

* cited by examiner

*Primary Examiner* — William H Rodriguez
*Assistant Examiner* — Carlos A Rivera
(74) *Attorney, Agent, or Firm* — Cantor Colburn LLP

(57) ABSTRACT

A gas turbine component in which combustion occurs. The gas turbine component includes a liner, including a first surface facing a first space and a second surface facing a second space, the liner being interposed between the first and second spaces and having a through-hole defined therein extending from the first to the second surface by which incoming flows proceed from the first space and to the second space. At least the first surface is formed to flow condition the incoming flows to resist separating from sidewalls of the through-hole.

6 Claims, 4 Drawing Sheets

FLOW CONDITIONER FOR USE IN GAS TURBINE COMPONENT IN WHICH COMBUSTION OCCURS

BACKGROUND OF THE INVENTION

Aspects of the invention relate to flow conditioning and, more particularly, to flow conditioning for dilution or mixing holes of gas turbine components in which combustion occurs.

Within gas turbine components in which combustion occurs, such as combustors and transition zones of gas turbines, the separation of incoming flows in and around dilution or mixing holes results in the generation of one or multiple recirculation pockets proximate to the dilution or mixing holes. During combustion operations and under combustion conditions, these recirculation pockets tend to ingest high temperature gases.

The ingestion of the high temperature gases through the dilution or mixing holes may lead to an incidence of relatively significant temperature increases of metals surrounding the dilution or mixing holes. This can lead to damage to the metals and the metallic structures surrounding the dilution or mixing holes. In addition, the residuals of combustibles can react in zones of the recirculation pockets. These reactions may result in detrimental attacks to metal grain boundaries and reductions in the mechanical properties of the metals.

BRIEF DESCRIPTION OF THE INVENTION

According to one aspect of the invention, a gas turbine component in which combustion occurs is provided and includes a liner, including a first surface facing a first space and a second surface facing a second space, the liner being interposed between the first and second spaces and having a through-hole defined therein extending from the first to the second surface by which incoming flows proceed from the first space and to the second space, wherein at least the first surface is formed to flow condition the incoming flows to resist separating from sidewalls of the through-hole.

According to another aspect of the invention, a gas turbine component in which combustion occurs is provided and includes a liner, including a first surface facing a first space and a second surface facing a second space, the liner being interposed between the first and second spaces and having a through-hole defined therein extending from the first to the second surface by which incoming flows proceed from the first space and to the second space, and a protrusion disposed on the first surface and sufficiently proximate to a perimeter of the through-hole to condition the incoming flows to resist separating from sidewalls of the through-hole.

According to yet another aspect of the invention, a gas turbine component in which combustion occurs is provided and includes a liner, including a first surface facing a first space and a second surface facing a second space, the liner being interposed between the first and second spaces and having a through-hole defined therein extending from the first to the second surface by which incoming flows proceed from the first space and to the second space. The first surface is formed with a depression sufficiently proximate to a perimeter of the through-hole to condition the incoming flows to resist separating from sidewalls of the through-hole.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
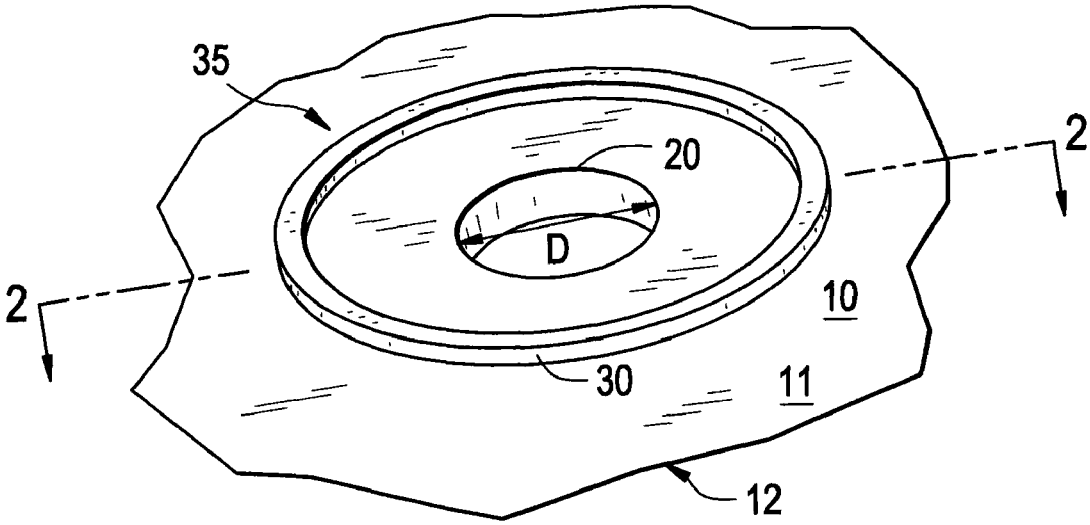
FIGS. 1 and 2 are views of an exemplary flow conditioner according to an embodiment of the invention.

The detailed description explains embodiments of the invention, together with advantages and features, by way of example with reference to the drawings.

DETAILED DESCRIPTION OF THE INVENTION

With reference to FIGS. 1-4 and in accordance with an aspect of the invention, a gas turbine component 10 in which combustion occurs, such as a combustor or a transition piece, is provided. The gas turbine component 10 includes a liner 10, such as a combustor liner or a wall of the transition piece, and a protrusion 30. The liner 10, being a component of the combustor liner or the transition piece, includes a first surface 11 facing a first space 13 and a second surface 12 facing a second space 14. The liner 10 is therefore interposed between the first and second spaces 13 and 14. In addition, the liner 10 has a through-hole 20 defined therein. The through-hole 20 extends from the first to the second surface 11 and 12 and allows for incoming flows to proceed from the first space 13 and to the second space 14. The protrusion 30 is disposed on the first surface 11 and is sufficiently proximate to a perimeter of the through-hole 20 to be positioned to provide flow conditioning for the incoming flows that, in turn, leads to a reduction in a separation of the incoming flows from sidewalls of the through-hole 20.

Where the liner 10 is, e.g., a combustor liner, the first space 13 represents a cold side, such as the annular space between a flow sleeve and a combustor liner of a gas turbine combustor, in which air flows and the second space 14 represents a hot side in which air and fuel are blended and flow together. In this case, the air flows from the first space 13 (the cold side) and into the second space 14 (the hot side). Due to the protrusion 30, this flow is conditioned, e.g., asymmetrically, and a separation between the flow and portions of sidewalls of the through-hole 20 is reduced. This separation reduction prevents temperatures of metals in and around the through-hole 20 from increasing excessively.

Figure 2:
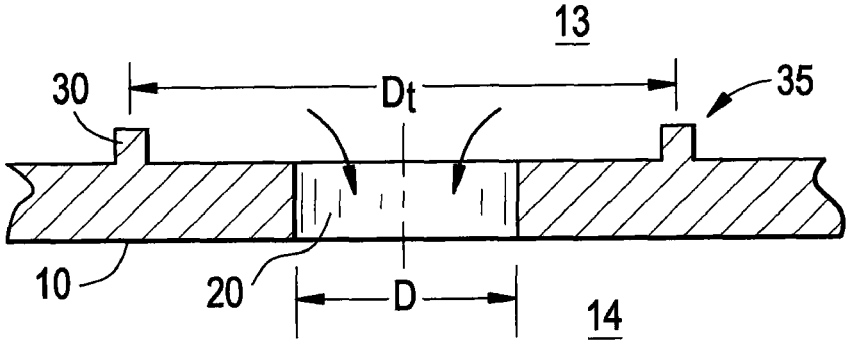

With reference now to FIGS. 1 and 2, the protrusion includes a local turbulator 35 that extends around a circumference of the through-hole 20. The local turbulator 35 may have various cross-sectional shapes and sizes including, but not limited to, an elevated portion of the first surface 11 and may be a single continuous feature or a plurality of similarly situated features. Where the local turbulator 35 is a single feature that extends around the circumference of the through-hole 20, a diameter $D_t$ of the local turbulator 35, in accordance with an embodiment, is about 1.2 to about 3 times a diameter D of the through-hole 20.

Figure 3:
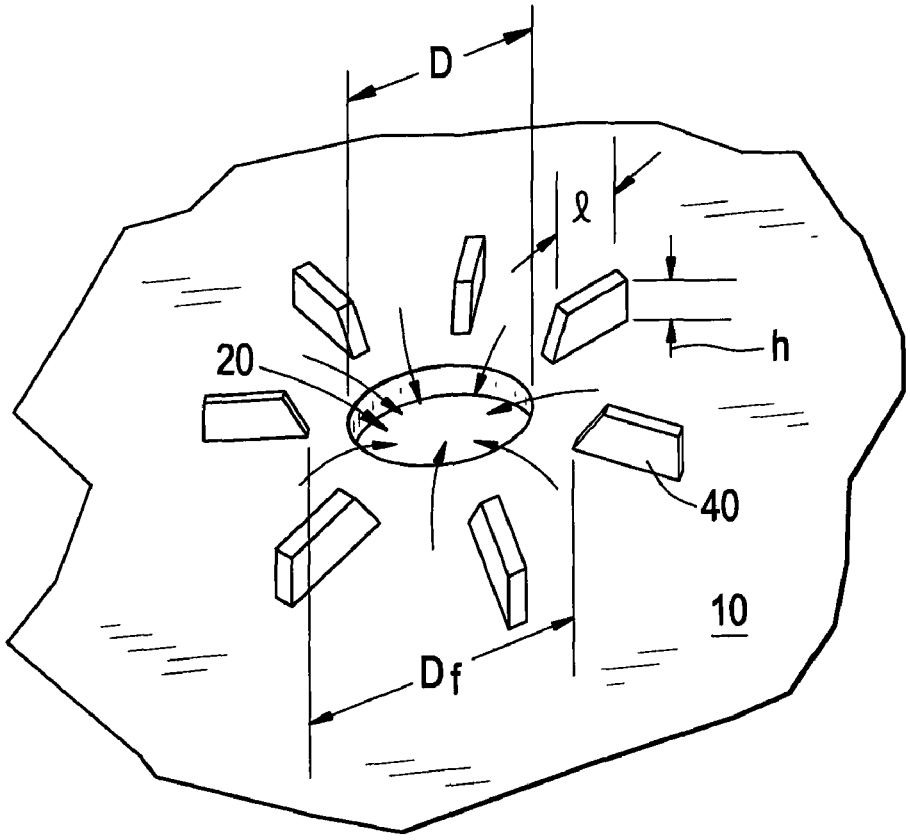
FIG. 3 is a perspective view of an exemplary flow conditioner according to another embodiment of the invention.

With reference to FIG. 3, the protrusion may be plural in number and may include a plurality of fins 40 arrayed around the circumference of the through-hole 20. In this case, each of the fins 40 is oriented in parallel with a radial axis of the through-hole 20. In accordance with an embodiment, a distance $D_f$ between fins 40 disposed on opposing sides of the through-hole 20 is about 1.1 to about 5 times the diameter D of the through hole 20, a height h of each of the fins 40 is about 10-about 20% of the diameter D of the through-hole 20 and a length 1 of a central portion of each of the fins 40 is about 20-about 30% of the diameter D of the through-hole 40. Of course, it is understood that each of these dimensions may be altered jointly or in combination in accordance with design analysis and cost considerations.

Figure 4:
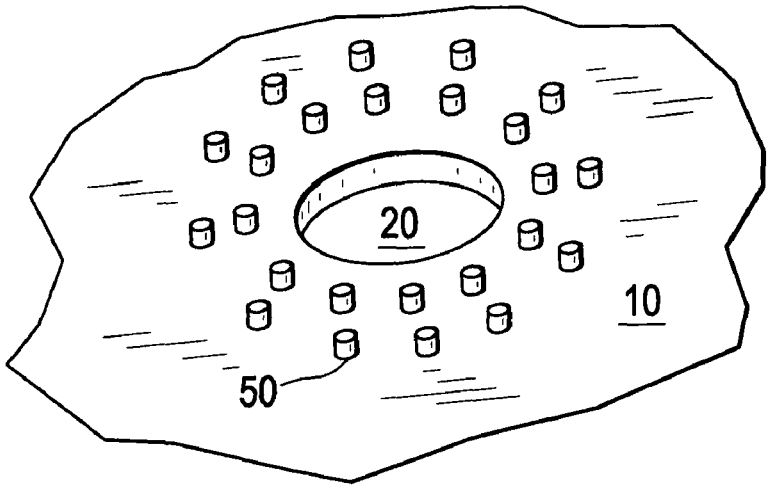
FIG. 4 is a perspective view of an exemplary flow conditioner according to another embodiment of the invention.

With reference to FIG. 4, the protrusion may be plural in number and may include a plurality of pimples 50, such as substantially cylindrical protrusions extending normally from the first surface 11, which are arrayed around the circumference of the through-hole 30. In an embodiment, the array of the plurality of the pimples 50 may be at least two pimples 50 deep.

Figure 5:
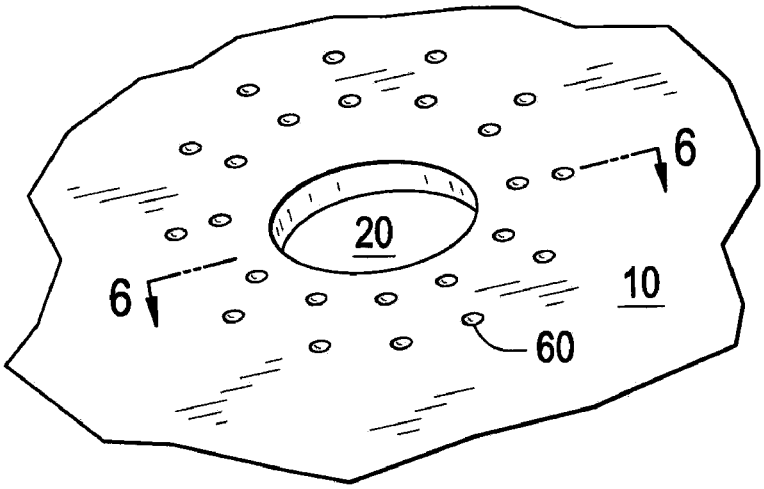
FIGS. 5 and 6 are views of an exemplary flow conditioner according to an embodiment of the invention.
Figure 6:
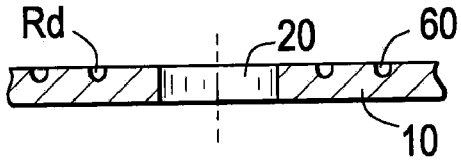
Figure 7:
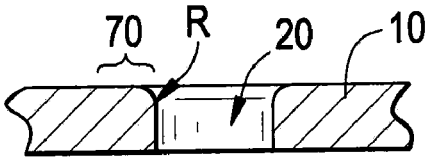
FIG. 7 is a side sectional view of an exemplary flow conditioner according to another embodiment of the invention.
Figure 8:
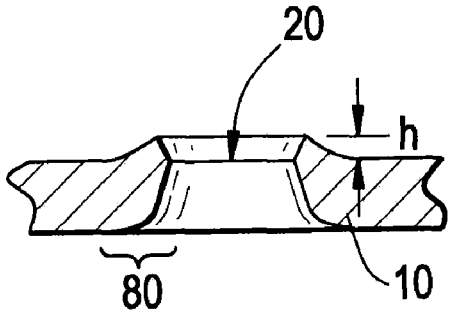
FIG. 8 is a side sectional view of an exemplary flow conditioner according to another embodiment of the invention.
Figure 9:
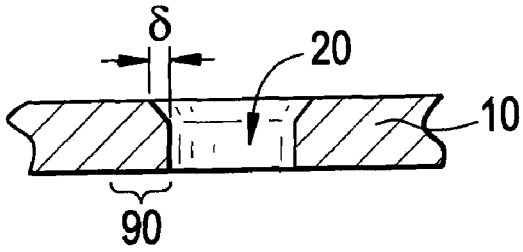
FIG. 9 is a side sectional view of an exemplary flow conditioner according to another embodiment of the invention.
Figure 10:
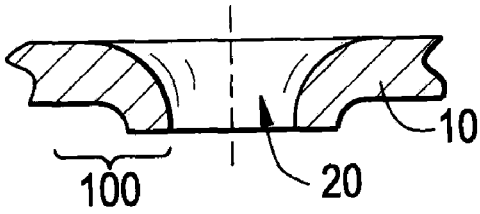
FIG. 10 is a side sectional view of an exemplary flow conditioner according to another embodiment of the invention.

With reference to FIGS. 5 and 6 and in accordance with another aspect of the invention, a gas turbine component in which combustion occurs is provided and includes a liner 10, as is generally described above, having a depression 60 formed in the first surface 11. In this case, the first surface 11 is formed with a depression 60 sufficiently proximate to a perimeter of the through-hole 20 to condition the incoming flows and thereby reduce a separation of the incoming flows from sidewalls of the through-hole 20 in a similar fashion as described above.

As shown in FIGS. 5 and 6, the depression 60 may be plural in number and may include a plurality of dimples 65 having a radius $R_d$. In an embodiment, the dimples 65 may be arrayed around the circumference of the through-hole 20 with the array being, in accordance with a further embodiment, at least two dimples 65 deep.

With reference now to FIGS. 7-10 and in accordance with yet another aspect of the invention, a gas turbine component in which combustion occurs is provided and includes a liner 10, as generally described above, in which at least one of the first and the second surfaces 11 and 12 are formed to flow condition the incoming flows and thereby reduce a separation thereof from sidewalls of the through-hole 20 in a similar fashion as is described above. In particular, the liner 10 may be formed such that the through-hole 20 is defined with a substantially cylindrical region that is at least partially surrounded by an annular region sufficiently sized and shaped to condition the incoming flows.

In accordance with various embodiments, the through-hole 20 may be radiused, raised, chamfered and/or plunged. That is, an edge of the through-hole 20 at the first and/or the second surface 11 or 12 may be rounded with a curvature R, as seen in feature 70 of FIG. 7. Alternatively, the edge of the through-hole 20 may be raised by height h with respect to the one of the first or the second surface 11 or 12, as seen in feature 80 FIG. 8. As another alternative, the edge of the through-hole 20 may include an oblique angle 90, as seen in the angled portion δ of FIG. 9. In still another alternative, the edge of the through-hole 20 may be plunged with respect to the one of the first or the second surface 11 or 12, as seen in feature 100 of FIG. 10.

In each arrangement described above, the flow conditioning of the incoming flow encompasses several fundamental regimes. Among these are the breaking of the boundary layer of the flow of incoming cooling air surrounding the through-hole 20, the enhancement of heat transfer around the through-hole 20 and the production of relatively high turbulence around the through-hole 20. Here, boundary layer breaking refers to the interruption of the boundary layer around the through-hole 20, which alters flow regimes inside the through-hole 20, reduces hot gas recirculation and stabilizes a jet inside the through-hole 20. Also, the enhancement of heat transfer relates to the presence of additional heat transfer surfaces provided by the protrusion 30 while the production of relatively high turbulence provides for increased heat transfer between the incoming flows and the heat transfer surfaces.

The reduction of the separation of the incoming flows from the sidewalls of the through-hole 20 caused by the flow conditioning has an effect of preventing or at least substantially inhibiting the generation of one or more recirculation pockets in the vicinity of the through-hole 20. As such, the ingesting of high temperature gases by recirculation pockets is limited and temperatures of metals in the vicinity of the through-hole 20 are maintained relatively low.

As examples, where the protrusion 30 includes the local turbulator 35, peak metal temperature surrounding the through-hole 20 has been shown to be reduced by about 200 degrees Fahrenheit. Similarly, wherein the protrusion 30 includes the plurality of the fins 40, the peak metal temperature has been shown to be reduced by about 300 degrees Fahrenheit.

In additional embodiments, the configurations described above may be combined with one another for particular liners 10 as is determined to be necessary. For example, the local turbulator 35 may be employed along with the chamfered through-hole 20 in one liner 10 and the array of the pimples 50 could be combined with the array of the dimples in another liner 10 to achieve a desired flow conditioning profile for each liner 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A gas turbine component in which combustion occurs, comprising:

a liner, including a first surface facing a first space and a second surface facing a second space, the liner being interposed between the first and second spaces and having a through-hole defined therein extending from the first to the second surface by which incoming flows proceed from the first space and to the second space, wherein at least the first surface is formed to condition the incoming flows to resist separating from sidewalls of the through-hole, a central portion of the through-hole has a substantially uniform diameter, an edge of the through-hole is radiused at the second surface such that a portion of the through-hole proximate to the second surface has an exponentially increasing diameter receding from the central portion and approaching the second surface, an edge of the through-hole is chamfered at the first surface such that a portion of the through-hole proximate to the first surface has a linearly increasing diameter receding from an angular end of the central portion and approaching the first surface, and wherein the chamfered edge of the through-hole is raised.

2. The gas turbine component in accordance with claim 1, wherein the through-hole is defined with a local turbulator that extends around the circumference of the through-hole to condition the incoming flows and to thereby reduce a separation thereof.

3. A gas turbine component in which combustion occurs, comprising:

a liner, including a first surface facing a first space and a second surface facing a second space, the liner being interposed between the first and second spaces and having a through-hole defined therein extending from the first to the second surface by which incoming flows proceed from the first space and to the second space; and a plurality of volumetric, polygonal fins disposed on the first surface sufficiently proximate to a perimeter of the through-hole to condition the incoming flows to resist separating from sidewalls of the through-hole, the plurality of the fins being substantially evenly distributed about a perimeter of the through-hole at the first surface and disposed to protrude outwardly from a plane of an outermost inlet portion of the through-hole at the first surface, and the plurality of the fins being arrayed around a circumference of the through-hole such that each fin is oriented substantially parallel with a radial axis of the through-hole and includes a surface facing the through-hole that forms an acute angle with the first surface.

4. The gas turbine component according to claim 3, wherein a distance between fins disposed on opposing sides of the through-hole is about 1.1 to about 5 times a diameter of the through hole.

5. The gas turbine component according to claim 3, wherein a height of each of the fins is about 10-about 20% of a diameter of the through-hole.

6. The gas turbine component according to claim 3, wherein a length of a central portion of each of the fins is about 20-about 30% of a diameter of the through-hole.

* * * * *